United States Patent [19]

Pallmann

[11] Patent Number: 4,583,574

[45] Date of Patent: Apr. 22, 1986

[54] FLAKER FOR TRUNK AND RESIDUAL WOOD

[75] Inventor: Wilhelm Pallmann, Zweibruecken, Fed. Rep. of Germany

[73] Assignee: Pallmann Maschinenfabrik GmbH & Co. KG, Zweibruecken, Fed. Rep. of Germany

[21] Appl. No.: 706,688

[22] Filed: Feb. 28, 1985

[30] Foreign Application Priority Data

Feb. 29, 1984 [DE] Fed. Rep. of Germany ..... 3407383

[51] Int. Cl.[4] ..... B27L 11/02; B27C 1/00

[52] U.S. Cl. ..... 144/172; 144/162 R; 144/180; 144/242 A

[58] Field of Search ..... 144/172, 180, 242 R, 144/162 R, 242 A

[56] References Cited

U.S. PATENT DOCUMENTS 3,913,643 10/1975 Lambert ..... 144/172

FOREIGN PATENT DOCUMENTS 841642 4/1952 Fed. Rep. of Germany .
1012061 12/1957 Fed. Rep. of Germany .
1300230 4/1970 Fed. Rep. of Germany .
2542340 7/1976 Fed. Rep. of Germany .
3301922 8/1984 Fed. Rep. of Germany .

*Primary Examiner*—Francis S. Husar
*Assistant Examiner*—Jorji M. Griffin
*Attorney, Agent, or Firm*—Schwartz, Jeffery, Schwaab, Mack, Blumenthal & Evans

[57] ABSTRACT

Disclosed is a flaker for trunk and residual wood for the direct production of a mass of chips free of splinters and low in fines. Flaking takes place within a blade rotor equipped with a replaceable blade ring, which together with its housing may be moved back and forth in front of the outlet of a wood feed chute equipped with pressure elements. A compression chamber is located inside the blade ring, in which the wood to be cut intermittently abuts against a counter support. The compression chamber is equipped with additional pressure elements in order to hold the wood substantially still and without fluttering, until it is cut, without leaving a residue, even in the case of wood of large cutting width. The additional pressure elements act transversely to the counter support. A stationary, slightly raised entrance barrier is arranged directly in front of the compression chamber. To prevent residual sections from assuming positions detrimental to the cutting process, an axially displaceable guide plate is provided in the compression chamber and the pivot axles of the pressure elements are arranged so that their pressuring motion deviates only slightly from the circle of rotation of the blade ring.

16 Claims, 8 Drawing Figures

II
III
M
R
H
d
e
c
z
α

FLAKER FOR TRUNK AND RESIDUAL WOOD

BACKGROUND OF THE INVENTION

The present invention concerns a flaker for trunk wood and residual wood for the direct production of flat chips, strands and wafers from round stock, billet wood or slabs not already cut to length.

A flaker of this type, known from German Patent No. 1,300,230, comprises a cutting assembly, including a pot-shaped blade rotor which rotates about a horizontal axle. The housing of the known machine is open in front. The blade rotor moves up and down with an upwardly directed working stroke, in front of the opening of a feeding chute equipped with a feeding mechanism and with pressure elements. A cutting chamber fastened to the housing and formed by parallel, vertical side walls is provided inside the blade rotor. A pressure shoe acting as a movable pressure element, and fixable counter support protrude into the cutting chamber to initially compress the stack of wood pushed from the feeder chute into the cutting chamber and then hold the wood during the working stroke. To limit the working stroke, the slide rod of the pressure shoe is equipped with a stop cooperating with a terminal switch mounted on the housing. The pressure shoe is vaulted on its effective side, corresponding to the inner circumference of the blade rotor, and divided into several independently effective pressure segments.

This flaker was intended (see introduction to the description of German Patent No. 1,300,230) to eliminate disadvantages connected with the then already known flaker of the same generic type, wherein the cutting assembly moves back and forth in the horizontal direction in front of the opening of the wood feeder chute, while the stack of wood clamped into the feeder chute is pressed against a stop standing upright in said chute during the working stroke. Even though the displacement of the stop and the counter support from the feeder chute into the inside of the cutter rotor, proposed in German Patent No. 1,300,230, improved the pressure conditions in the cutting zone, this structural measure was not sufficient to advance the performance quantitatively and qualitatively to such a degree that would make is possible for this cutting principle to compete successfully with the cutter block flakers successfully used in long timber cutting.

This remained true in spite of the fact that the operational and economic advantages of the flaking of long timber inside a cutter rotor have been known to those skilled in the art for a long time because of good results obtained with ring flakers in chip chopping. These species specific advantages are found not only in the homogeneous chip quality resulting from the calibrating effect of the ring flaker, but result primarily because this high chip quality may be maintained consistently by means of the rapid and effective elimination of wear effects. Elimination of wear effects is achieved either by simple grinding or by the replacement of worn parts as installed, or by the rapid, complete replacement of the ring flaker with a new or reconditioned one, so that the cutting tool may be restored to its new condition at minimal cost and in the shortest possible time. In addition, the ring flaker could possibly be constructed with further comminution elements or with ventilation or rake blades to aid in the discharge of the chips, which discharge may thus be effected in any direction. In view of these obvious advantages, there has been for decades no lack of intensive efforts in the industry to introduce ring or basket flakers into the direct cutting of long timber.

Such efforts are evidenced by German Patents Nos. 841,642 and 1,012,061, which already describe internal cutters of this type for stem timber or the like, not already cut to length, wherein the rotating cutting ring is stationary, however, and the stack of wood is clamped in the area of the opening of the mobile feeder chute by pressure elements acting laterally and from above. In this manner it is only possible to control a cutting width approximately corresponding to the normal length of a chip, which is altogether inadequate for the economical production of chips. Furthermore, it is not possible thereby to satisfactorily cut the short trunk ends or other residual sections no longer gripped by the pressure elements of the feeder chute.

U.S. Pat. No. 3,913,643 (corresponding to German Offenlegungsschrift No. 25 42 340) describes another flaker with a pot- or basket-shaped blade rotor intended for flaking wood stock already cut to length. The wood is therefore of equal length and also approximately the same thickness, with the length of the pieces corresponding to the working width of the cutter rotor. The wood to be cut is pushed in stacks over its entire length into a box arranged inside the cutter rotor and subsequently forced by the moving bottom of the box against the inner periphery of the stationary cutter rotor, whereupon it is cut by the inwardly protruding cutting blades. However, this known flaking machine cannot be compared even generically with the machine according to the invention, because it is only capable of cutting wood already cut to length, i.e., specially prepared wood. It is not capable of cutting stock and residual wood of any length and thickness, i.e., in a state in which it is obtained, such as directly in the course of wood cutting in the forest. In order to process wood of this type into high quality chips at an economically acceptable cost, certain problems must be resolved, which, as set forth below, do not, of course, even occur in the cutting of wood already cut to length.

SUMMARY OF THE INVENTION

It is an object of the present invention to further develop the flaking machine described above for stack and residual wood of any length and thickness, so that it may be used not only to produce an economically satisfying quantitative output, but primarily also homogeneous chips of a constant high quality, permitting further industrial processing without any cumbersome and expensive secondary screening. At the same time, maintenance and repair advantages of ring flakers known from chip chopping, such as the ability to rapidly change the entire cutter ring or the ability to grind the rings inner surface while installed, are to be maintained.

The realization of this object according to the present invention is based on the discovery that a quantitative and qualitative improvement of the performance of flakers of the aforedescribed generic type is possible only if it is made feasible to introduce a compression system inside the blade rotor despite prevailing narrow spatial conditions. The compression system must be capable of compressing the stack of wood inserted in sections into the cutting chamber not only in the direction of the advance of the cutting assembly, as is known, but must also compress transversely without interfering with the advancing movement of the cutting assembly. The latter is an essential further condition.

These two, actually contrary, requirements are fulfilled by the characteristics of the wood flaker according to the invention.

In the compression chamber according to the invention, the stack of wood is compressed directly in the cutting zone by means of two pressure systems acting transversely to each other. Not only is wobble-free and immobile clamping of the wood in the cutting zone assured even in the case of a large cutting width, but also the end pieces which are no longer seized by the pressure elements arranged in front of the compression chamber are held securely in their original proper cutting position until they are completely cut up without remaining residues. This is of decisive importance for a constant high chip quality.

To prevent an appreciable interference of the high compression forces with the relative sliding of the stack of wood during the work stroke, a stationary entrance barrier is placed in front of the compression chamber. The threshold is raised slightly with respect to the bottom of the chamber, thereby for the most part absorbing the compressive forces originating in the compression of the wood stack, so that the bottom plate of the compression chamber is able to slide under the stack of wood without hindrance.

The rear terminal wall of the compression chamber stops the intermittent input movements of the wood stack into the compression chamber and protects the frontal surfaces of the wood pieces against energy consuming frictional forces and thus also against chip damaging shocks, which would otherwise be caused by the rotation of the hub disk of the blade rotor on the wood stack.

Achieving regular cutting without residual stem ends and other residual sections obtained in the cutting of stem and residual wood not already cut to length, and therefore of unequal length, poses a special problem; such sections are obtained more often with woods of shorter overall lengths. Because these residual sections are no longer held by the pressure elements located in front of the compression chamber, in particular on the feeder chute, they could uncontrollably assume positions in the compression chamber in which their fibers are no longer parallel to the blades of the cutters. This interferes with the flaking process and has a detrimental effect on the quality of the chips produced.

If, for example, the position of such a residual piece of wood is such that cutting takes place along the fibers, undesirably long chips are obtained which can no longer be eliminated by the calibrating effect of the ring cutter. On the other hand, a residual section of this type may occupy a position during cutting wherein the direction of cutting is perpendicular to the fibers, whereby unusable fine chips and wood dust are produced. End pieces of wood in transverse positions further cause premature wear of the blades and interfere with the regular, intermittent input of the stack of wood into the compression chamber, leading to an inadequate filling and thus to a reduced quantitative output of the flaker.

It is therefore a further object of the invention, within the overall objectives, to prevent the placing of stem ends and other residual sections in the compression chamber in positions which are unfavorable for the flaking process and thereby hinder the production of homogeneous chip material.

This object is attained according to a particular embodiment of the present invention.

These characteristics are based on the discovery that the aforedescribed positions of residual sections detrimental for the flaking process may have two different causes. Firstly, such residual sections may drop prematurely into the compression chamber during the intermittent input of the wood stack and occupy uncontrollable positions in this manner. Secondly, such a detrimental cutting position may also occur if the residual sections are not being held adequately during the flaking process, so that they may be moved into favorable positions by the cutting forces acting upon them. Understandably, both causes affect the pieces as an inverse function of the length of the end pieces in relation to their diameter, i.e., when they are disk-like in shape.

The first cause is eliminated according to one embodiment of the present invention, wherein a guide plate, which may be displaced in the axial direction of the blade rotor, is provided within the compression chamber. Each time the cutting assembly returns to its initial position following a work stroke, this guide plate is pushed from the compression chamber until it abuts against the frontal surfaces of the wood stack still held in the feeder chute. Subsequently, after the wood stack in the feeder chute is released for the next intermittent input into the compression chamber, the guide plate is returned into its initial position synchronously with the advancement of the wood. Because the frontal surfaces of the wood pieces are constantly in contact with the guide plate in the process according to the invention, the possibility that residual sections could get into unfavorable cutting positions during the input motion is thereby eliminated.

With respect to the above embodiment, it is already known from German Offenlegungsschrift No. 33 01 922, in the case of long wood cutters with roll shaped cutting tools, (i.e., so-called cutter block cutters) to provide a guide plate displaceable in the transport direction of the feeder chute, (a "displaceable impact wall") in the stationary cutting chamber opposite the opening of the wood feeder chute. Even though this already largely prevents the uncontrollable shifting of residual sections during the intermittent feeding of wood into the cutting chamber in the case of cutter block machines, only the guide plate proposed according to the invention for the input of the wood into the compression chamber in combination with the remaining characteristics of the present invention is capable of yielding an economic breakthrough. The aforementioned guide plate is able to contribute decisively to the attainment of the overall object of producing a completely homogeneous mass of chips requiring no secondary screening only in combination with the measures according to the embodiments of the present invention. For the first time ever, economic cutting of stem wood of unequal length is made possible by the annular blade cutter according to the present invention.

The second cause of the undesirable movements of end pieces of wood within the compression chamber is eliminated according to the invention by a further characteristic of another embodiment, wherein the pivoting axles of the pressure elements on the front side of the housing and/or on wall sections of the compression chamber perpendicular to the axle are arranged in a manner such that they are located on the extension of an (imaginary) straight line connecting the axle of the blade rotor with the center of the pressure zone. As a result of this geometric configuration, the contact projections of the pressure elements describe a circular arc, the radius of which is larger than that of the circle of the cutter. In this manner, the contact projections are able to bring their pressuring movement in the initial and terminal positions as close to the cutting circle as may be desired, while in the intermediate range of their pressuring movement they move away only slightly from the cutting circle, so that the holding effect intended by the invention, particularly for residual sections, is not impaired.

The invention not only provides means to apply cutting by blade rings to the processing of stem and residual wood of any length and thickness economically for the first time ever, but it also makes it possible, as shown by numerous experiments, to obtain a homogeneous mass of chips without splinters and low in fines, so that, as a rule, cost-increasing secondary screening of the chips is not needed. This high quality of the chips cannot be affected detrimentally over longer periods of time by wear effects. According to the invention, provisions are made to avoid interference by the compression system of the invention with the early and cost-effective elimination of wear effects by methods known from and proven in the chopping of chips by blade rings.

It is therefore possible according to an advantageous embodiment of the invention to replace the cutting ring without difficulty following the pivoting of the counter support from the compression chamber and the lateral displacement of the cutting assembly from the area of the feeder chute, and to restore in this manner the cutting tool to its new condition at a low cost and within a short period of time. It is not even necessary to remove the compression chamber if it is supported by its rear closure wall on a rigid axle in keeping with a further embodiment of the invention. It suffices in this case to pivot the frontal mounting of the chamber from the area of the blade ring.

Further objects, features and advantages of the present invention will become apparent from the detailed description of preferred embodiments which follows, when considered together with the attached figures of drawing.

BRIEF DESCRIPTION OF THE DRAWINGS In the drawings.

Figures 1, 6:
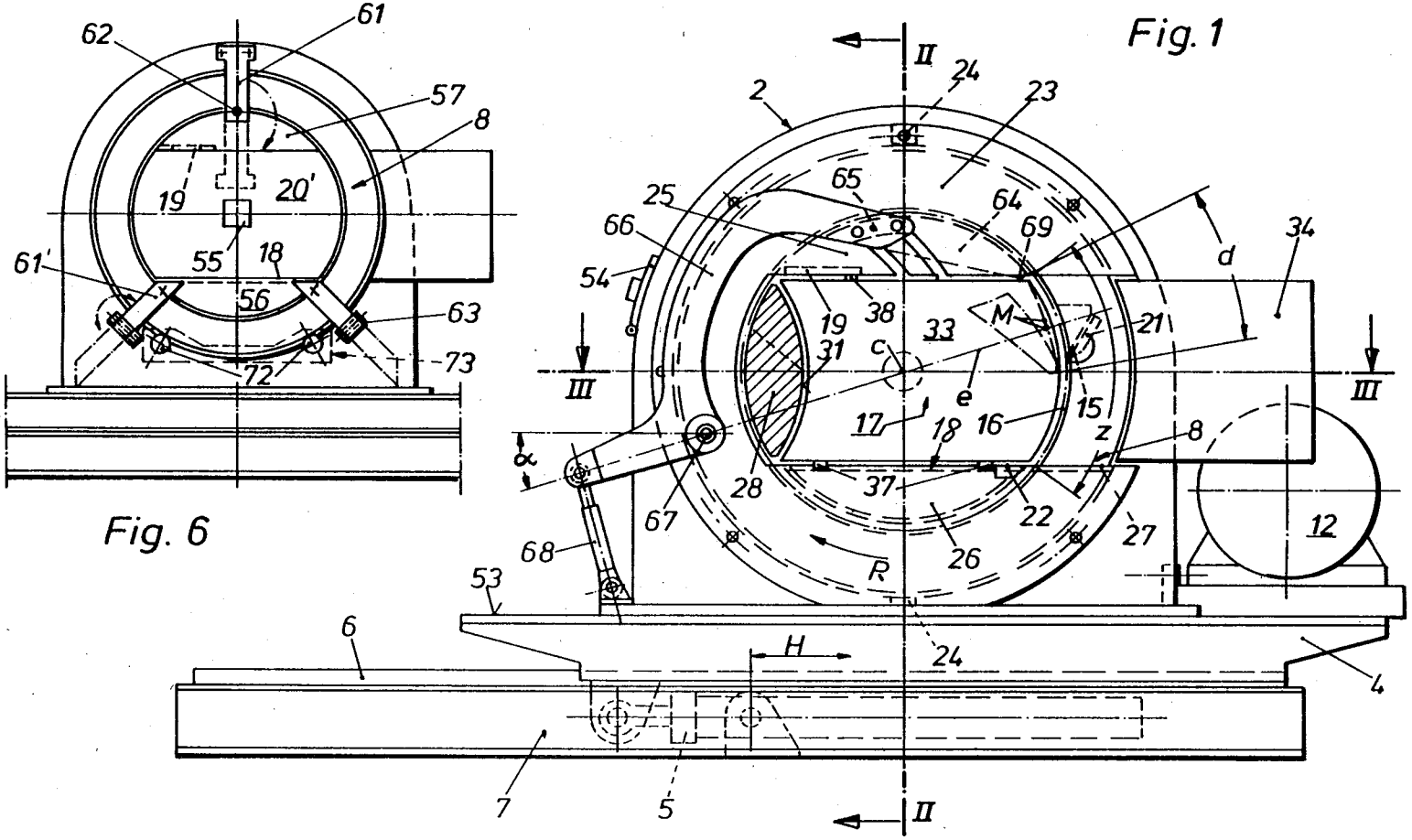
FIG. 1 is a cross-sectional view of a first embodiment of the present invention through the line I—I of FIGS. 2 and 3.
Figure 2:
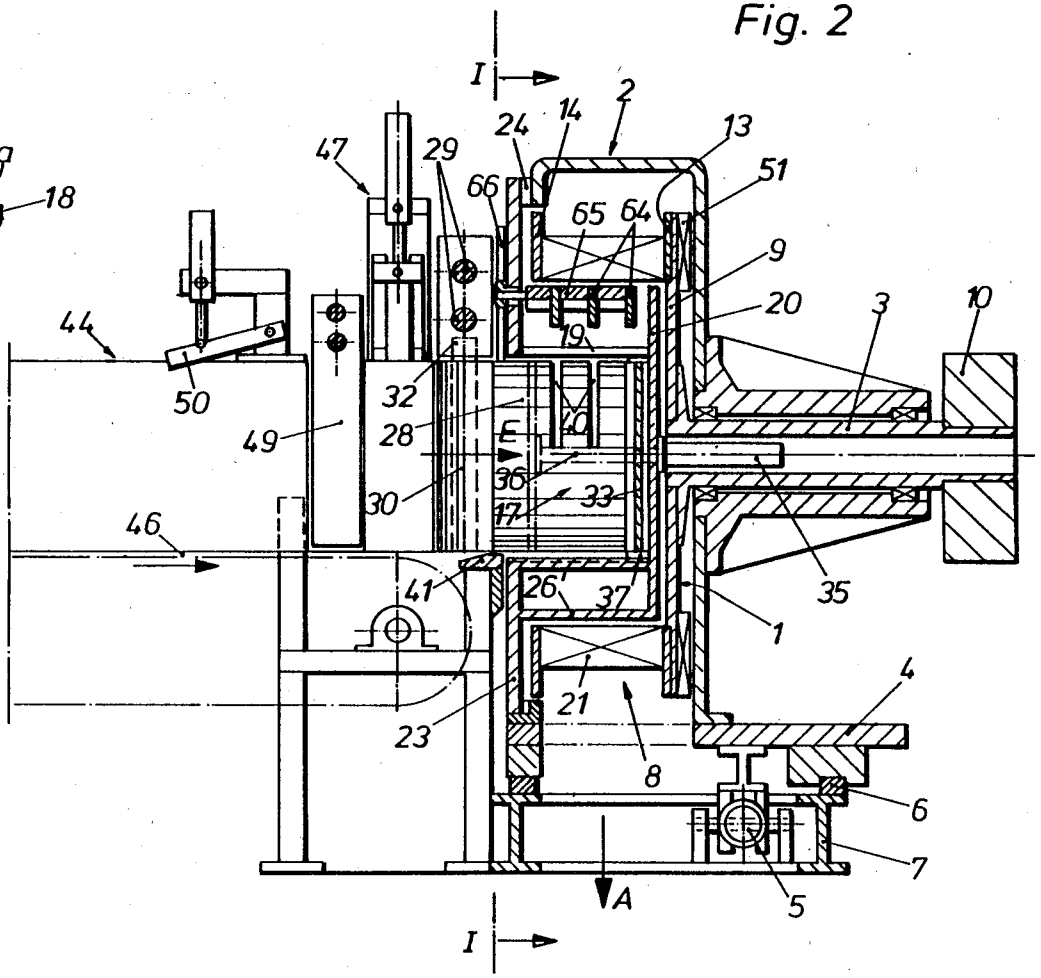
FIG. 2 is a section taken along the line II—II in FIG. 1.
Figure 2A:
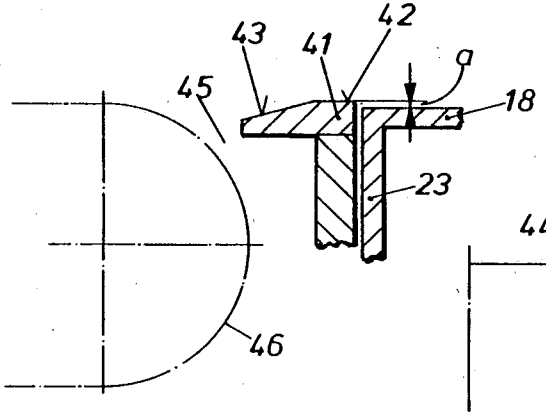
Figure 3:
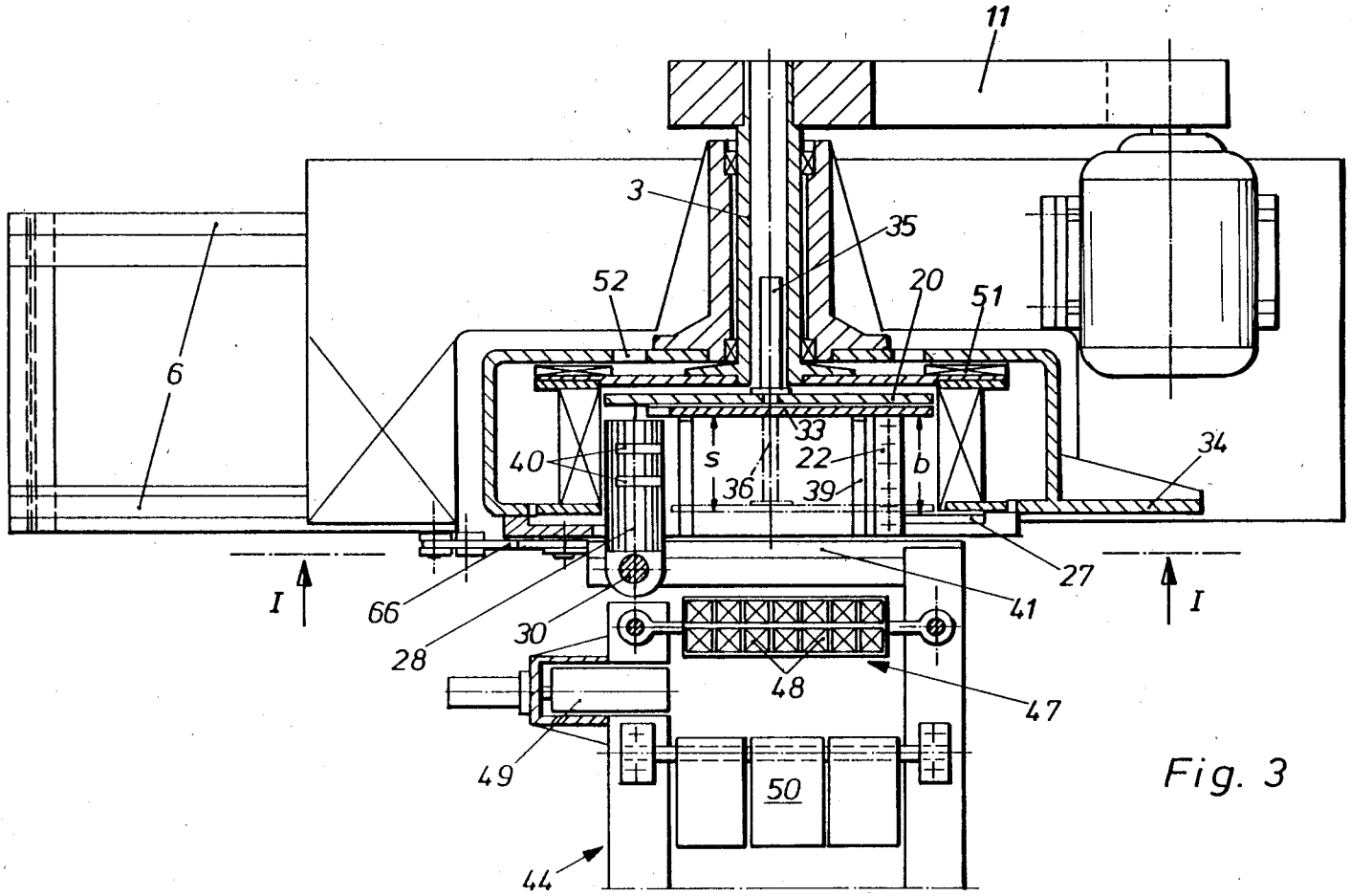
Figure 5:
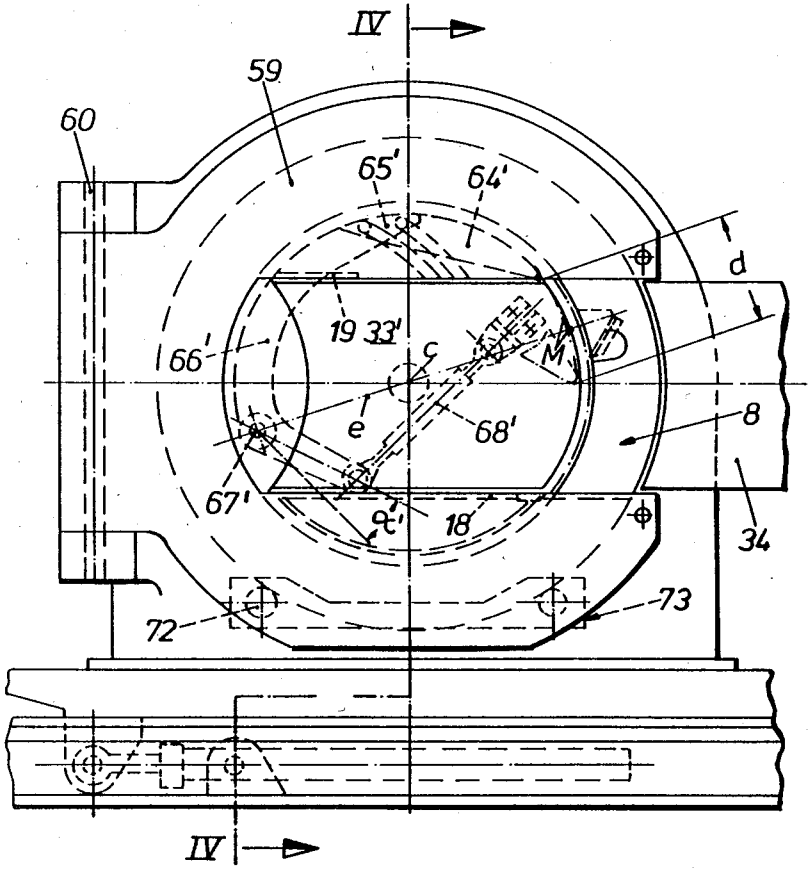
Figure 4:
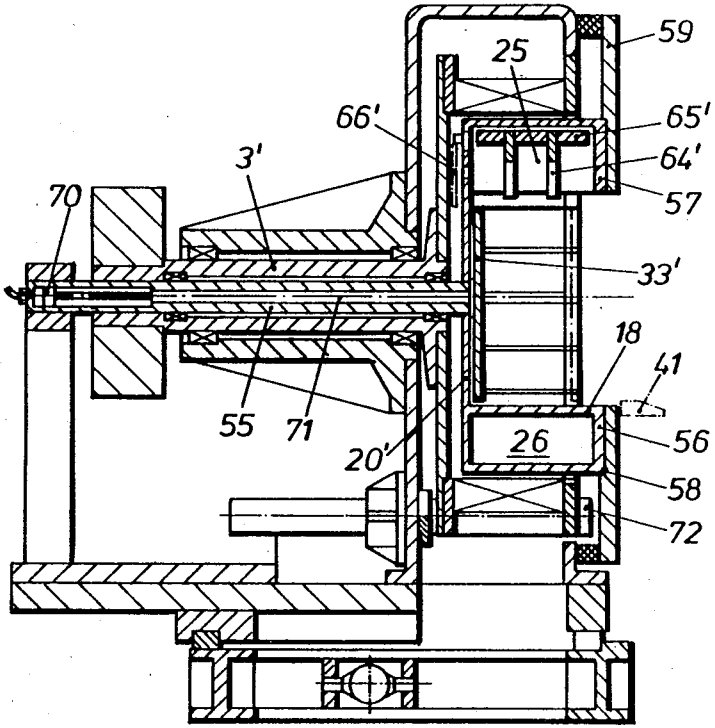

FIG. 2*a* shows a detail of FIG. 2, enlarged;

FIG. 3 is a top view of a section taken along the line III—III in FIG. 1;

FIG. 4 is a cross-sectional view of a second embodiment of the invention taken along the line IV—IV of FIG. 5;

FIG. 5 is a front elevation view of FIG. 4;

FIG. 6 shows a variant of a second embodiment on a reduced scale; and

Figure 7:
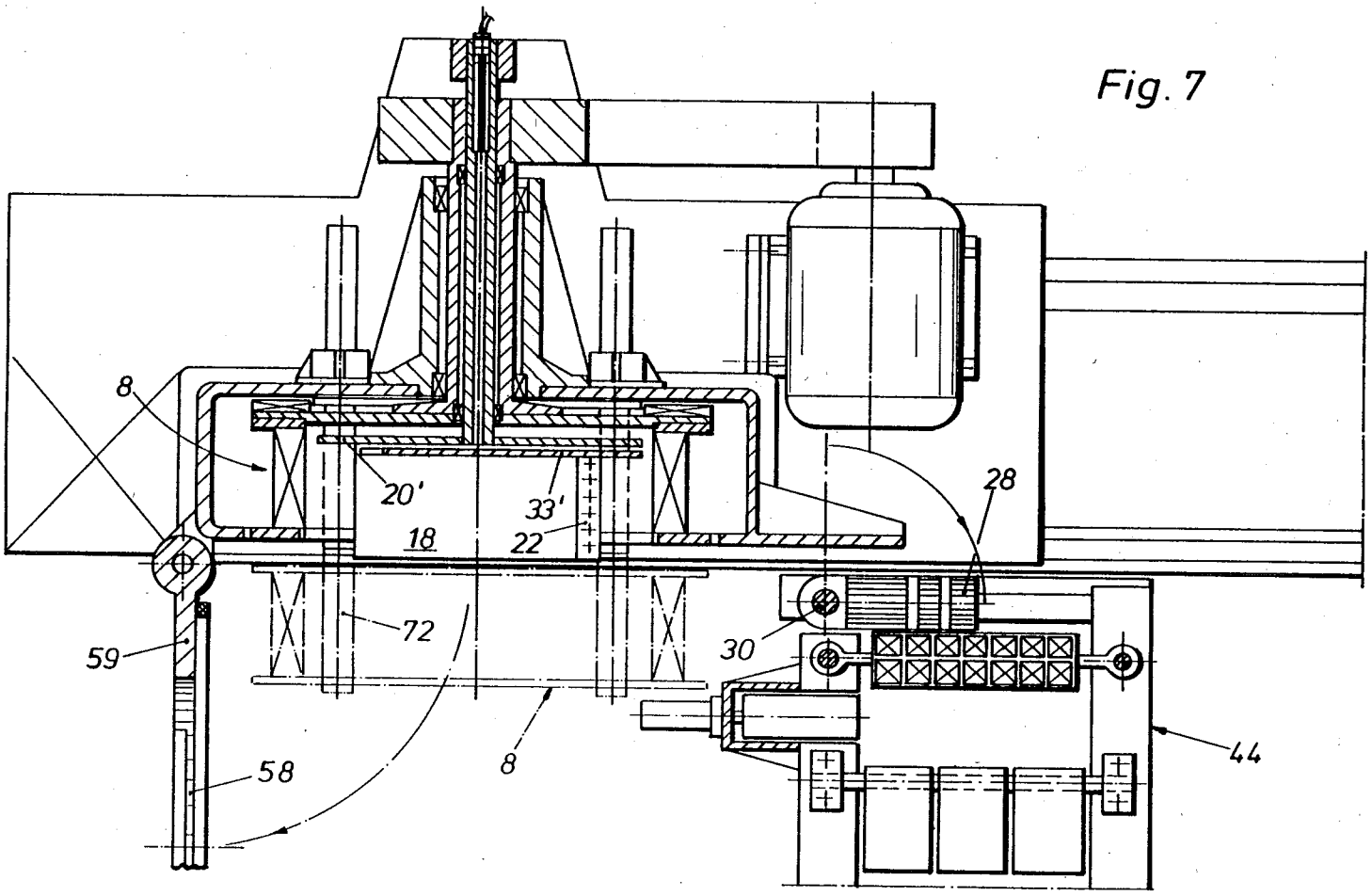

FIG. 7 shows a second embodiment of the invention, wherein the cutting assembly is in position to replace the ring cutter.

DETAILED DESCRIPTION OF PREFERRED EMBODIMENTS

The cutting assembly shown largely in front view in FIG. 1 comprises a blade rotor 1, which is overmounted on a rotor shaft 3 and in a housing 2 with an opening in front. The blade rotor rotates in the direction of the arrow R. The housing 2 is mounted on a slide 4. The slide 4 may be moved back and forth by means of a pressure controlled advance installation 5. The slide moves along a slide track 6 on a stationary base frame 7 and transversely to the rotor axle, i.e. in the direction of the double arrow H.

The blade rotor 1 comprises a blade ring 8, fastened in a replaceable manner to a hub disk 9 seated on the rotor shaft 3. A belt pulley 10 is seated at the free end of the hollow rotor shaft 3. The pulley is coupled with a motor 12, also mounted on the slide 4, by means of a belt drive 11.

A plurality of flaking blades 15 are secured to blade support plates 21 in a manner not shown in detail. The blade support plates are disposed on the blade ring 8, between a rear blade support ring 13 fastened to the hub disk 9 and a front blade support ring 14. The edges of the cutting blades 15 are directed inwardly. During rotation of the blade rotor 1, the blades form in a known manner the cutting circle 16, corresponding to the blades' regular projection over the internal periphery of the blade ring 8. In order to assure the freedom of the flanks of the blades necessary for a satisfactory parting cut, the axle of the cutter rotor 1 (as seen in a top view) is not aligned exactly perpendicular to the direction of motion H of the slide 4, but deviates slightly (in a manner not shown).

A compression chamber 17 is arranged in the internal space of the blade rotor 1 surrounded by the circle of blade support plates 21. The compression chamber 17 is bounded at its base by a base plate 18 extending horizontally on both sides to near the cutting circle 16, and bounded on the top side by a parallel cover plate 19 which only partially covers the compression chamber 17. Space segments 25 and 26, defined on the one hand by the internal circumference of the blade ring 8 and on the other by the cover plate 19 and the base plate 18, respectively, are located above and below the compression chamber 17. On the rear side, the compression chamber 17 is bordered by a rear terminal wall 20 which covers the hub disk 9 of the blade rotor 1. The distance between the base plate 18 and the cover plate 19 delineates the cutting zone "z". The base plate 18 is equipped with a counter blade 22 at the lower edge of the cutting zone "z".

The compression chamber 17 is fastened to the front side of the housing 2 by means of a front disk 23, connected with the compression chamber and covering the blade ring 8 except for the cutting zone "z". Radial ventilation channels 24 are provided in the front disk 23. In the area of lower space segment 26, the base plate 18 connects the front disk 23 with the rear closure wall 20, and together with a cylindrical wall section 26', forms a closed hollow body which reinforces the compression chamber 17. At the height of the base plate 18, a replaceable, flat gap boundary 27, made of a made of a wear-resistant material, is fastened to the inner side of the front disk 23. The gap boundary extends over the width of the front blade support ring 14.

A counter support 28 protrudes into the open, front side of the compression chamber 17. The counter support has convex surfaces 31 on both sides, corresponding to the radius of the blade cutting circle 16. The counter support 28 is mounted on a support 32 by means of an axle 30. The support may be displaced on stationary slide rods 29 in the direction of motion "H" of the slide 4 with the aid of a hydraulic thrust drive. During the work stroke, the counter support 28 may be immobilized after it has been moved into the compression position. In addition, when the blade rotor is at rest, the counter support 28 may be pivoted out of the compression chamber 17 around its axle 30.

To the side of the compression chamber 17, and in the area of the cutting zone "z", a flat protective shield 34 is fastened to the frontal side of the housing 2. The front side of the shield is located in the plane of the cut and therefore moves in front of the freshly cut frontal surfaces of the stack of wood in the course of the work stroke. The path of the cutting assembly 1, 2 is thus protected against the penetration of pieces of wood into the track during the work and return strokes, which could interfere with the working process.

A guide plate 33, which may be displaced in the axial direction of the blade rotor 1, is arranged within the compression chamber 17, and in front of the rear terminal wall 20. A hydraulic pressure assembly 35 serves as the thrust drive for the guide plate 33; it is housed in the hollow rotor shaft 3 and acts on the rear side of the guide plate 33 with its push rod 36. The cylinder of the pressure assembly 35 is fastened to the rear side of the rear terminal wall 20 of the compression chamber 17. The lower and upper edge of the guide plate 33 is equipped with undercarriage skids 37 and 38. The lower skids 37 slide in guide grooves 39 provided in the bottom plate 18, parallel to the axle. The thrust path "s" of the guide plate 33 corresponds exactly to the working width "b" of the blade rotor 1, so that in the extended state the front side of the guide plate 33 is aligned accurately with the front side of the protective shield 34.

Over the compression chamber 17, and in the space segment 25, a plurality of contact blades 64 are arranged comb-like on a common blade carrier 65 each with individual spring action. The blade carrier 65 is rigidly connected with the longer lever arm of an angular lever 66. The pivot axle of the angular lever 66 is mounted on the front disk 23 of the compression chamber 17 so that it is located on an extension of the straight line "e" connecting the rotor axis "c" with the center "M" of the pressure zone "d" of the pressure catches 69. A hydraulic pressure assembly 68, coupled to the base plate of the housing 2, acts on the shorter lever arm of the angular lever 66. If the angular lever 66 is pivoted by an angle $\alpha$, the pressure catches 69 of the contact blades 65 move into a position indicated by a phantom line in FIG. 1 on a circular path, which in the initial and terminal positions may be as close to the blade rotation circle 16 as may be desired and which moves away only slightly in the intermediate range of the path. To prevent interference by the contact blades 64 with the working process, suitable slits 40 are provided in the counter support 28.

A stationary entrance barrier 41 is arranged directly in front of the compression chamber 17. The support surface 42 of the entrance barrier is raised slightly by a distance "a" with respect to the base plate 18 of the compression chamber 17. Toward the feed chute 44, the bottom of which is a conveyor belt 46, the threshold 41 is equipped with an inclined ramp surface 43. A gap 45 left between the threshold 41 and the conveyor belt 46 of the feeder chute 4 serves to screen out dirt and foreign bodies. The conveyor belt 46 of the feeder chute 44 may comprise a slat conveyor set with pusher elements.

The pressure elements provided in the area of the feed chute 44 include in a known manner a so-called vertical pressure bar assembly 47 comprising pressure bars 48 which slide in vertical guides, a lateral contact slide 49 which moves and stops synchronously with the counter support 28, and contact tabs 50.

To provide good ventilation of the cutting assembly, the rear side of the hub 9 is produced with vanes 51 and the housing 2 is provided with corresponding orifices 52 on the rear side.

A platform 53 is provided on the side 4 next to housing 2, from whence the replacement of the cutting blades 15 or of the complete cutting packs consisting of the blades 15 and the blade holder plates 21, may be effected when the flap 54 of the housing is open.

A second embodiment of the invention shown in FIGS. 4 to 6 differs from the one described above essentially in that the compression chamber 17 is also supported in the rear. The compression chamber 17 is specifically supported by means of a rigid axle 55, which is concentrically contained by the hollow rotor shaft 3', and fastened with the rear terminal wall 20' of the compression chamber 17. On its front side, the compression chamber 17 is indirectly connected with the housing 2 by means of frontal segment disks 56 and 57 which covers the lower and upper space segment 26 and 25 on the front side.

In the embodiment of the present invention shown in FIGS. 4 and 5 the frontal connecting element between the compression chamber 17 and the housing 2 comprises a front disk 59, which is mounted to the housing 2, like a door, by means of a pivot axle 60. The front disk 59 is provided with a hollow 58 on its inner side, which is contacted positively by the two frontal segment disks 56 and 57 upon the closing of the door-like front disk 59.

As shown in FIG. 6, the frontal connection between the compression chamber 17 and the housing 2 may also comprise tabs 61 and 61', which connect the segment disks 56 and 57, attached to the compression chamber 17 on top and bottom, with the housing 2. The tabs 61 and 61' may be pivoted into their positions indicated by phantom lines, and thus out of the range of the cutter ring 8, by means of bolts 62 in the plane of the drawing or by hinges 63, perpendicularly to it.

The embodiment according to FIGS. 4 to 6 has several advantages. Firstly, the compression chamber 17 is capable of absorbing significantly higher reactive forces applied by the contact blades 64', in view of its additional rear support by the rigid axle 55. Secondly, the replacement of the blade ring 8 is thereby greatly simplified, as it is no longer necessary to remove the compression chamber 17. Rather, it is sufficient to pivot away either the door-like front disk 59 or the tabs 61 and 61' from the range of the ring 8, so that the latter may be taken out by means of the bearer rods 72 of the hydraulically operated dismantling slide 73 from the housing 2.

In order to keep the actuating mechanism of the contact blades 64' from interfering with the advantage of the simple replacement of the blade ring 8, the entire kinematic pressuring apparatus in this embodiment is located in the space between the hub disk 9 of the blade rotor 1 and the rear terminal wall 20' of the compression chamber 17. In this layout, as can be particularly seen in FIG. 5, the hydraulic pressure assembly 68' is coupled to the rear side of the rear terminal wall 20', and with the pivot axle 67' of the angular lever 66', such that the connection with the rotor axle "c" and the center "M" of the pressure zone "d" forms a straight line "e".

As seen in FIG. 4, the second embodiment of the invention offers the further advantage that both the hydraulic thrust drive 70 and the axial slide guide 71 for the guide plate 33' may be housed in the hollow, rigid axle 55.

FIG. 7 shows the second embodiment of the invention according to FIGS. 4 and 5 in the position such that the blade ring 8 of the blade rotor 1 may be replaced. For this purpose, following the deactivation of the rotor drive, the counter support 28 is pivoted out of the compression chamber 17 around its axle 30, so that the blade rotor 1 and the housing 2, which form the cutting assembly, may be slid out laterally over the area of the feeder chute 44. Subsequently, the front disk is pivoted around its pivot axle 60 into the open position shown and the blade ring 8 released from the hub disk 9 of the blade rotor. After the blade ring 8 has been seated on the bearer rods 72 of the hydraulically operated dismantling slide 73, it may be moved into its replacing position 8', as known from German Offenlegungsschrift No. 27 14 575.

The flaker according to the invention operates in the following manner:

In the initial position shown in FIGS. 1 to 3, the cutting assembly comprises the blade rotor 1 and the housing 2, the frontal opening of the compression chamber 17 and the outlet of the feeder chute 44 face one another, while the counter support 28 is located laterally from the cross section of the chute. In this initial position, the guide plate 33 is first slid forward in the compression chamber 17 by the displacement distance "s", whereby its front side comes into contact with the frontal surfaces of the wood stack still being held by the holding elements (vertical pressure bar assembly 47 and pressure tabs 50) of the feed chute 44. The wood stack is then released by the holding elements 47 and 50 so that it may be inserted into the compression chamber by the intermittently operating slat conveyor 46 in the direction of the arrow E, with an advance corresponding to the cutting width "b" of the blade ring 8. In the process, the wood stack pushes the guide plate 33, the hydraulic thrust drive 35 of which is no longer under pressure, in front of itself, so that the frontal surfaces of the stack of wood are always in contact with the guide plate 33. In this manner the premature dropping of short residual sections into the compression chamber 17 wherein they could occupy positions detrimental to cutting, is prevented.

Following the completion of the insertion of the wood, the stack is pressed against the opposite wall of the feeder chute 44 by the counter support 28 and the lateral contact slide 49 moving synchronously with the counter support. After a predetermined, variable lateral contact pressure is obtained, the counter support 28 and the lateral contact slide 49 are stopped in the positions attained. Simultaneously, both the pressure elements 47 and 50 located above the feeder chute 44 and the contact blades 64 arranged over the compression chamber 17 are moved into their pressure positions. Following the attainment of an adjustable pressure in the compression chamber 17, the entire cutting assembly comprising the blade rotor 1 and the housing 2, is moved in the direction of the stationary counter support 28, together with the drive motor 12. In the course of this work stroke, the blade ring 8 cuts the wood compressed in the compression chamber 17 into uniform chips, which leave the cutting assembly in the direction of the arrow A. During the cutting process the contact blades 64, which are moved into the compression chamber 17 from above, slide over the stationarily held wood stack and continuously hold the wood pieces stationarily within the immediate cutting range. This is highly important primarily for satisfactory cutting without residue of short trunk ends and other residual sections, which are no longer held in front of the compression chamber by the holding elements 47 and 50. Toward the end of the work stroke, the contact blades 64 sliding in the slits 40 of the counter support 28 are slowly pressured upwardly by the counter support and, shortly prior to the completion of the work stroke, moved upwardly and entirely out of the compression chamber. As soon as the cutting circle 16 of the blade ring 8 has reached the effective vaulted side 31 of the counter support 28 without contact, the cutting assembly 1, 2 and the counter support 28, together with the lateral contact slide 49 are returned rapidly into their initial positions, whereupon a new working cycle begins.

What is claimed is:

1. A flaker for cutting wood of any length and thickness, comprising:

a housing having an opening in front;

a feed chute for holding a supply of wood and disposed in front of said opening in the housing;

a feeding apparatus including a first plurality of pressure elements for grasping the wood and connected with the feed chute;

a cutting circle defined by an outline of the blade rotor when said blade rotor rotates about said axis;

a compression chamber within said blade rotor;

a counter support having an arched, convex side for extending into the compression chamber, wherein said counter support is movable with respect to and may be fixed at a given position with respect to said blade rotor;

a rear terminal wall for defining a rear boundary of said compression chamber;

a base plate for defining a lower boundary of said compression chamber;

a fixed entrance barrier disposed directly in front of said compression chamber and at a small height above said base plate; and a second plurality of pressure elements for grasping wood in said compression chamber and disposed opposite the base plate in the compression chamber.

2. A flaker as claimed in claim 1, further comprising a guide plate for guiding wood into said compression chamber, a slide guide for slidable holding the guide plate and a thrust drive for thrusting the guide plate in a direction along said axis of rotation of said blade rotor.

3. A flaker as claimed in claim 2, further comprising a rigid hollow shaft disposed in said blade rotor for housing said thrust drive for said guide plate, and fastened to said rear terminal wall, wherein said slide guide is provided on said guide plate.

4. A flaker as claimed in claim 2, further comprising a rigid hollow axle for rotatingly supporting said blade rotor and for containing said thrust drive and said slide guide, wherein said slide guide comprises an axial sliding guide for said guide plate.

5. A flaker as claimed in claim 1, wherein said second plurality of pressure elements grasp said wood in a discrete pressure zone having a center, wherein the second plurality of pressure elements comprises a pivoting axle for pivotably supporting the pressure elements, wherein the axle of said second plurality of pressure elements is disposed so that the pressure elements pivot in such a manner that the center of the pressure zone, the pivoting axle for the pressure elements and said axis about which said rotor rotates all lie on a single straight line, and wherein said pressure elements pivot in a circular arc.

6. A flaker as claimed in claim 5, wherein said pivoting axle is mounted on said housing.

7. A flaker as claimed in claim 5, further comprising structures perpendicular to the axis of the blade rotor, wherein said pivoting axle is mounted on said structures.

8. A flaker as claimed in claim 5, wherein said second plurality of pressure elements comprises a plurality of contact blades with individual spring actions, and a common blade carrier for carrying the contact blades.

9. A flaker as claimed in claim 5, further comprising an auxilliary pressure element pivotally held on said pivoting axle and disposed in front of said compression chamber and separated means for driving said auxilliary pivoting element.

10. A flaker as claimed in claim 1, wherein said blade rotor comprises a replaceable blade ring having a front side, and wherein said flaker further comprises means for moving said blade rotor and said counter support out of said compression chamber, and means for laterally displacing said cutting assembly past said feed chute.

11. A flaker as claimed in claim 10, further comprising a front disk for fastening said compression chamber to said housing, wherein said front disk substantially covers the front side of said blade ring.

12. A flaker as claimed in claim 10, further comprising a rigid axle for supporting a rear section of said compression chamber on said rear terminal wall, and holders for supporting a front section of said compression chamber, wherein said holders pivot away from said blade ring.

13. A flaker as claimed in claim 12, further comprising a front disk pivotably attached to said housing, and a frontal mounting for mounting said compression chamber disposed on said front disk.

14. A flaker as claimed in claim 12, further comprising a top frontal segment disk for bounding said compression chamber on top and in front, a bottom frontal segment disk for bounding said compression chamber on top and in front, tab means for connecting said top and bottom segment disks to said housing, and pivoting means for pivoting said tab means away from said blade ring.

15. A flaker as claimed in claim 14, wherein said pivoting means comprise bolts.

16. A flaker as claimed in claim 14, wherein said pivoting means comprise hinges.

* * * * *